US005247539A

United States Patent [19]

Gillhaus

[11] Patent Number: 5,247,539

[45] Date of Patent: Sep. 21, 1993

[54] MAGNETIC YOKE FOR AN INDUCTION CRUCIBLE FURNACE

[75] Inventor: Horst Gillhaus, Dortmund, Fed. Rep. of Germany

[73] Assignee: ABB Patent GmbH, Mannheim, Fed. Rep. of Germany

[21] Appl. No.: 881,474

[22] Filed: May 11, 1992

[30] Foreign Application Priority Data

May 10, 1991 [DE] Fed. Rep. of Germany ..... 4115278

[51] Int. Cl.[5] ..... H05B 6/22

[52] U.S. Cl. ..... 373/153; 373/151; 373/152; 373/154; 373/160; 29/732; 335/18; 335/227; 204/129.5; 204/129.6

[58] Field of Search ..... 373/138, 150, 151, 152, 373/153, 154, 158, 160, 161; 29/732; 335/227, 18, 236, 281; 204/129.5, 129.6

[56] References Cited

U.S. PATENT DOCUMENTS

| | | | |
|---|---|---|---|
| 1,827,274 | 10/1931 | Willcox | 373/153 |
| 1,830,481 | 11/1931 | Northrup | 373/153 |
| 1,834,445 | 12/1931 | Brace | 373/153 |
| 2,852,587 | 9/1958 | Junker | 373/153 |
| 2,997,512 | 8/1961 | Tama | 373/153 |
| 3,602,625 | 8/1971 | Duca . | |
| 3,704,336 | 11/1972 | Synneetvedt | 373/153 |
| 4,198,614 | 4/1980 | Ragland, Jr. | 335/211 |
| 4,873,698 | 10/1989 | Boen | 373/156 |

FOREIGN PATENT DOCUMENTS

| | | |
|---|---|---|
| 0232846 | 8/1987 | European Pat. Off. . |
| 0311506 | 4/1989 | European Pat. Off. . |
| 968717 | 3/1958 | Fed. Rep. of Germany . |
| 2420533 | 11/1975 | Fed. Rep. of Germany . |
| 3405120 | 11/1986 | Fed. Rep. of Germany . |
| 1220513 | 8/1968 | France . |
| 102802 | 12/1973 | German Democratic Rep. . |
| 1463071 | 2/1977 | United Kingdom . |

OTHER PUBLICATIONS

Publication No. D MelD118 289 D (ABB).

*Primary Examiner*—Bruce A. Reynolds
*Assistant Examiner*—Tu Hoang
*Attorney, Agent, or Firm*—Herbert L. Lerner; Laurence A. Greenberg

[57] ABSTRACT

A magnetic yoke for an induction crucible furnace includes a rod-shaped core stack being suitable for carrying magnetic flux generated by a furnace coil of the induction crucible furnace. The core stack is enclosed on three principal surfaces thereof not facing the furnace coil by a flexurally and torsionally rigid support body having a C or U-shaped cross section. The support body is preferably formed of a material with good electrical conductivity and has longitudinal channels suitable for carrying a coolant. Preferably, an extruded profiled part formed of an aluminum alloy is used.

23 Claims, 3 Drawing Sheets

MAGNETIC YOKE FOR AN INDUCTION CRUCIBLE FURNACE

BACKGROUND OF THE INVENTION

1. Field of the Invention

The invention relates to a magnetic yoke for an induction crucible furnace having a rod-shaped core stack being suitable for carrying magnetic flux generated by a furnace coil of the induction crucible furnace, the core stack being enclosed on three principal surfaces thereof not facing the furnace coil by a body having a C or U-shaped cross section.

Such a magnetic yoke is disclosed in U.S. Pat. No. 3,704,336.

2. Description of the Related Art

A similar magnetic yoke for an induction crucible furnace is disclosed in Publication No. D ME/D 118 289 D of the firm ABB. That induction crucible furnace is suitable for inductive melting of cast iron, steel, light metal, heavy metal and alloys, with an operation taking place, for example, at frequencies of 125 to 1000 Hz in the case of a construction as a medium-frequency induction crucible furnace. A current converter is used in order to establish an alternating voltage of a specified frequency.

The active part of the induction crucible furnace is the furnace coil which has an interior that is lined with a ceramic crucible. The alternating current flowing through the furnace coil generates an alternating magnetic field which is carried by metallic charge material inside th furnace crucible and by an iron core stack of the magnetic yokes outside the coil. The alternating magnetic field induces eddy currents in the metallic charge material, i.e. electrical energy which is converted into heat. Due to the transformer principle, the furnace consumes power from the supply mains, so that with energy constantly being supplied, the charge material is caused to melt. The electromagnetic forces acting on the melt result in an intensive bath agitation which ensures a rapid heat equalization and material equalization.

The magnetic yokes are disposed on the outside of the coil in the form of individual stacks that are distributed with gap over the circumference of the coil parallel to the furnace axis. The iron core stacks of the magnetic yokes serve the purpose of carrying the alternating magnetic flux, as already mentioned above. In this connection, a path of low magnetic resistance should be offered to the magnetic flux. The path at the same time only causes low eddy current losses. The use of the magnetic yokes reduces the reactive power necessary as a consequence of the reduction in the magnetic resistance in the yoke region of the flux. In addition, the flux is prevented from entering the generally ferromagnetic supporting outer structural components of the furnace (furnace body with casing) and the heating of the latter by eddy currents is consequently prevented.

A further purpose of the magnetic yokes is the radial bracing of the core against the electromagnetically produced forces and the forces produced by the thermal expansion of the refractory crucible.

In modern high-power induction crucible furnaces having a power of 1MW/tonne of content of metallic charge material, the production, amplification and propagation of soundwaves, in particular, also has to be avoided.

In order to be able to fulfil such tasks, the magnetic yokes themselves must satisfy certain requirements:

The material carrying the alternating flux must have a high permeability and low eddy current losses. The construction is normally of suitable thin, mutually electrically insulated transformer laminations havin high electrical resistivity.

The magnetic yokes must have a sufficiently high mechanical section modulus in the radial direction in the installed state in order to make it possible to transmit the entire bracing forces (up to 100 tonnes/$m^2$ of coil surface and over) with as few support points as possible.

The magnetic yokes should be torque-resistant and the second moments of area in the longitudinal direction (against bending) and against torsion should be high, in particular, in order to avoid resonances.

The individual laminations of the core stack of the magnetic yoke must be pressed together sufficiently strongly in order to avoid vibrations of the individual laminations (otherwise noise generation and, under certain circumstances, a destruction of the insulation of the laminations with the risk of core burning also occurs.

The section modulus of the magnetic yokes in the radial direction is essentially determined by their radial extent, and for this reason the dimensioning of the core stacks often has to be larger than would be necessary for reasons of the actual purpose, which is the carrying or guiding of the magnetic flux. Such a solution requires comparatively high costs to achieve the necessary or desirable section modulus.

The above-mentioned necessary compression of the core stacks in the direction perpendicular to the individual laminations can be carried out in various ways: what is generally known is the use of clamping bolts which are passed through holes in the core stacks. Such a structure permits a sufficiently good clamping, in particular, if a sufficient number of such clamping points is used or if, with few individual clamping points, the clamping forces are distributed uniformly over the entire area to be clamped by suitably stiff cover sheets on both sides of the core stack. Such a structure has the advantage of permitting the clamping to be readjusted to the optimum value at any time, but it has the disadvantage of making a fairly large number of holes additionally necessary in the laminations. That results in additional cut edges which may a have burr formation, if the construction is not quite exact or, for example, if the punching tool is worn. That gives rise to the risk of an electrical contact between the iron laminations and the core burning caused thereby.

A further clamping method in which the individual aminations are clamped between two cover plates which are clamped by clamping elements is also generally known. For example, the stacks may be welded with the cover plates and clamping elements may be prestressed. That structure has the advantage of providing very simple lamination shapes having only straight cut edges which can easily be of burr-free construction. However, there are the disadvantages that a subsequent adjustment of the clamping pressure is no longer possible and the specific contact pressure is not uniform.

Meanwhile it has been found that, in addition to the eddy current losses which are caused by the alternating magnetic field extending predominantly parallel to the laminations, eddy current losses, which are appreciable in some cases, occur at certain points in the core stack in a positionally limited manner. In the gap between the furnace coil and the melt and also in the region of the alternating magnetic field in the melt, the magnetic resistance is constant over the coil circumference, i.e. in the azimuthal direction, and accordingly, the flux densities along the coil circumference are also constant and the flux lines extend continuously parallel to the furnace axis. On the other hand, with the configuration of the magnetic yokes at the coil circumference described above, regions having low magnetic resistance alternate with regions having high magnetic resistance (core stacks and gaps) in the yoke space of the field on the outside of the furnace coil. Accordingly, for the flux, regions of high magnetic conductance are disposed in parallel with those of very low conductance. In the external region of the coil, the flux consequently largely takes its path through the regions of high conductance, that is to say it is carried virtually exclusively in the core stacks. However, at the coil ends or cor stack ends it propagates in the circumferential direction in order to go over in the interior of the coil into flux density which is uniform in the circumferential direction. Under the circumstances, some of the flux in the end region of the core stacks emerges from the stacks at right angles to the stacking plane of the laminations. As a result, appreciable additional eddy current losses, which may result in local overheating of the core stacks and of the covering laminations, are generated in the end region of the core stacks. At correspondingly large powers, separate, expensive, additional cooling systems are necessary at such points.

It is accordingly an object of the invention to provide a magnetic yoke for an induction crucible furnace, which overcomes the hereinafore-mentioned disadvantages of the heretofore-known devices of this general type and which, despite an overall simple construction, has a high moment of inertia or second moment of area and torsional moment.

SUMMARY OF THE INVENTION

With the foregoing and other objects in view there is provided, in accordance with the invention, in an induction crucible furnace having a furnace coil generating magnetic flux, a magnetic yoke comprising a rod-shaped core stack for carrying the magnetic flux, the core stack having three principal surfaces not .facing the furnace coil, and a flexurally and torsionally rigid support body of a material with good electrical conductivity enclosing the three principal surfaces and having a C or U-shaped cross section.

The advantages which can be achieved with the invention are, in particular, that the enclosure of the core stack in a support body ensures a high rigidity in relation to bending and torsion of the magnetic yoke with comparatively low material usage, a high damping over the transmission path from the coil to the furnace housing for radial vibrations and a high thermal conductivity for the heat loss generated during operation.

Due to the high rigidity of the support body, it is possible to restrict the bracing of the magnetic yoke against the furnace body in the radial direction to two points for each magnetic yoke near the ends of the core stacks. This makes it possible to achieve statically determined conditions and the desired contact pressure can easily be established in a defined manner. The use of a separate furnace-body frame bar for each magnetic yoke is unnecessary, with the result that the furnace body can be constructed more simply and in a material-saving manner. The magnetic yokes are expediently braced against the furnace body by means of a lower and an upper frame of high rigidity and high natural frequency. Accordingly, only high, harmless resonant frequencies are fed from the furnace coil through the magnetic yokes to the frame. In addition, vibration-damping components which very severely damp any transmission of the vibrations originating from the furnace coil and at least partially conducted to the furnace body through the magnetic yokes can be built into these braces at minimum expense.

A further damping can be achieved even during the transmission of vibrations from the furnace coil to the core stacks by lining the magnetic yokes or their support bodies with vibration-damping components on their side facing the coil.

The production, amplification and propagation of soundwaves is avoided by a package of measures which are employed individually or in any desired combination as required. Thus, the conduction of electromagnetically induced vibrations in the furnace coil to the furnace body is damped in an optimum manner, with the result that the radiation of sound from the induction furnace to the environment is minimized.

If the core stacks are enclosed by a support body of high electrical conductivity on the three sides not facing the furnace coil, the entry and emergence of flux components at right angles to the direction of lamination is prevented in a screening sense. Additional losses and, consequently, additional heating, in particular in the end regions of the core stacks are consequently avoided, with the result that special measures for their removal can be waived.

The removal of the eddy-current heat losses produced in the core stacks is possible in a very simple way by using the longitudinal channels of the support body at least partially for carrying coolant. Depending on the heat transmission area needed, one, two, three or more longitudinal channels can be used as coolant channels. This ensures that the temperature of the core stacks is kept within permissible limits. Water, for example, may be used as a coolant. The use of separate cooling devices which have to be brought into direct thermal conduction contact with the core stacks is unnecessary.

In accordance with another feature of the invention, the support body is formed of a material selected from the group consisting of aluminum and an aluminum alloy.

In accordance with a further feature of the invention, the support body has at least one longitudinal channel formed therein.

In accordance with an added feature of the invention, the support body has at least one longitudinal channel formed therein for carrying a coolant.

In accordance with an additional feature of the invention, the support body has a one-piece construction.

In accordance with yet another feature of the invention, the support body has three parts.

In accordance with yet a further feature of the invention, the support body includes at least one extruded profiled part.

In accordance with yet an added feature of the invention, the support body has two side walls, one rear wall and joints between the rear wall and the side walls being formed of fixing screws.

In accordance with yet an additional feature of the invention, the support body has two side walls, one rear wall and joints between the rear wall and the side walls being formed of clamps.

In accordance with again another feature of the invention, the core stack is glued in the support body.

In accordance with again a further feature of the invention, the core stack is clamped in the support body.

In accordance with again an added feature of the invention, the support body has two side walls and one rear wall, and there are provided clamping bolts having a thrust block in the side walls for clamping the core stack in the support body.

In accordance with again a additional feature of the invention, there is provided a rigid cover plate disposed between the core stack and the side walls.

In accordance with still another feature of the invention, the clamps clamp the core stack in the support body.

In accordance with still a further feature of the invention, the clamps have side cheeks, and there are provided clamping bolts having a thrust block in the side cheeks for clamping the core stack in the support body.

In accordance with still an added feature of the invention, there is provided a rigid cover plate disposed between a side cheek of one of the clamps and one of the side walls of the support body.

In accordance with still an additional feature of the invention, there are provided fixing wedges in the support body for fixing the core stack.

In accordance with another feature of the invention, there is provided thermally conducting paste between the core stack and the support body.

In accordance with a further feature of the invention, the support body has end surfaces facing the furnace coil, and there are provided vibration-damping components disposed at said end surfaces.

In accordance with an added feature of the invention, there are provided holding lugs formed onto the support body for fixing the vibration-damping components.

In accordance with an additional feature of the invention, the support body has two side walls and one rear wall constructed as a steel profiled part.

In accordance with again another feature of the invention, the support body has at least one principal surface, and there is provided a steel profiled part being fixed on the at least one principal surface.

In accordance with again a further feature of the invention, the steel profiled part is glued on the support body.

In accordance with a concomitant feature of the invention, the support body has holding lugs for locking the steel profiled part.

Other features which are considered as characteristic for the invention are set forth in the appended claims.

Although the invention is illustrated and described herein as embodied in a magnetic yoke for an induction crucible furnace, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
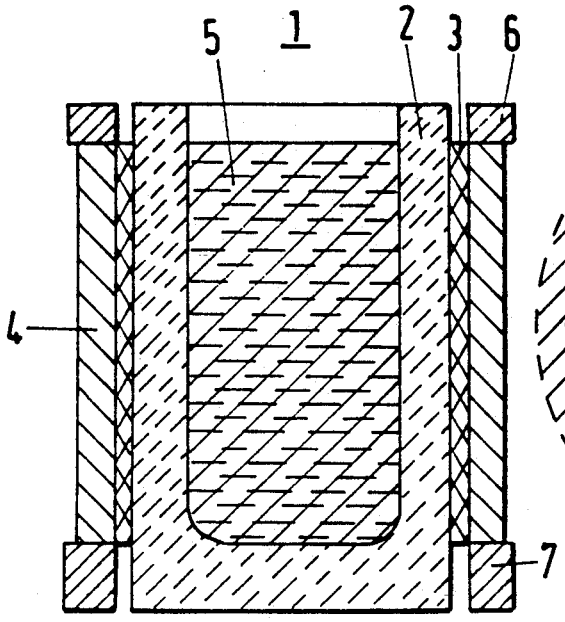
FIG. 1 is a diagrammatic, lateral-sectional view of an induction crucible furnace.

Referring now to the figures of the drawing in detail and first, particularly, to FIG. 1 thereof, there is seen a lateral sectional view of an induction crucible furnace. The induction crucible furnace 1 is formed of a refractory, preferably ceramic, cylindrical crucible 2 which is closed at the bottom and open at the top, a cylindrical coil 3 fitting round the crucible 2 and a plurality of magnetic yokes 4 which are constructed in the form of individual rods disposed parallel to the furnace axis at the outer lateral surface of the coil. A melt (which is a molten metallic charge material) in the interior of the crucible 2, is indicated by reference numeral 5. The separate rod-type magnetic yokes 4 are clamped to the furnace coil 3 by respective upper and a lower frames 6 and 7. These frames 6, 7 form part of a non-illustrated supporting furnace body.

Figure 2:
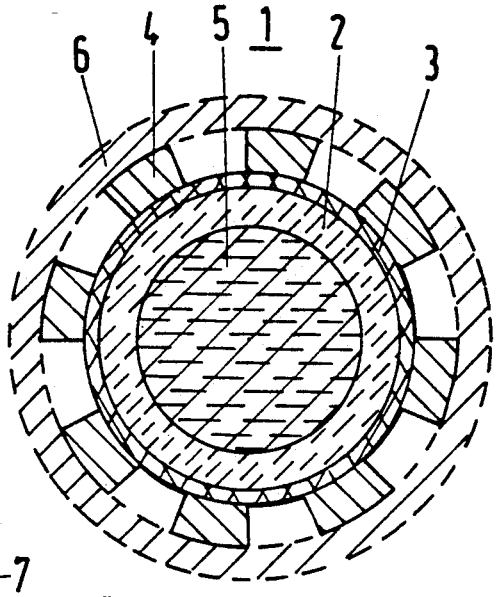
FIG. 2 is a plan view of an induction crucible furnace.

FIG. 2 shows a top-plan view of an induction crucible furnace 1 with the crucible 2, the melt 5, the furnace coil 3, the separate rod-type magnetic yokes 4 and the upper frame 6. In FIG. 2, the frame 6 is of annular construction, but it may also have a square shape, for example. Gaps are formed between the separate magnetic yokes 4. The actual supporting furnace body is not illustrated for reasons of clarity.

Figure 3:
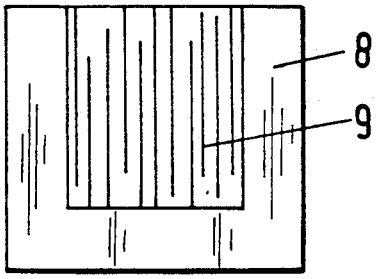
FIG. 3 is a sectional view of a first basic structure of a magnetic yoke.

FIG. 3 shows a first basic structure of a magnetic yoke in section. It can be seen that an active core stack 9 is enclosed in a C or U-shaped manner by a single-piece support body 8. In particular, the support body is expediently constructed as an extruded profiled part which is preferably made of an aluminum alloy and has the advantage of high electrical conductivity. The core stack 9 includes a multiplicity of separate, mutually electrically insulated individual laminations, as explained above.

Figure 4:
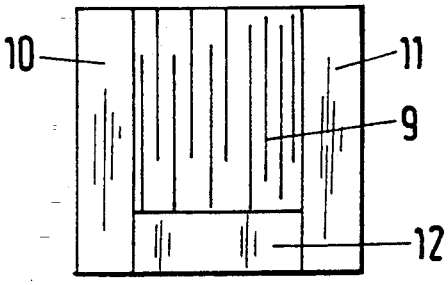
FIG. 4 is a sectional view of a second basic structure of a magnetic yoke.

FIG. 4 shows a second basic structure of a magnetic yoke in section. In contrast to the structure shown in FIG. 3, the active core stack 9 in this case is enclosed by a support body including three individual profiled parts. The three individual profiled parts, namely two side walls 10, 11 and a rear wall 12, surround the core stack in a C or U-shaped manner, with the rear wall 12 being joined to the two side walls 10, 11 in a suitable manner that is still to be described below.

Figure 5:
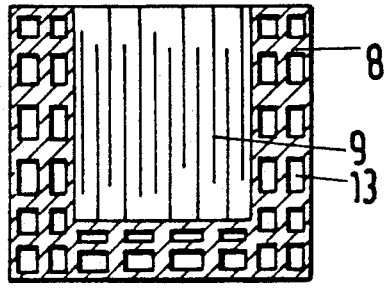
FIG. 5 is a sectional view of a magnetic yoke with a single-piece extruded profiled part.
Figure 8:
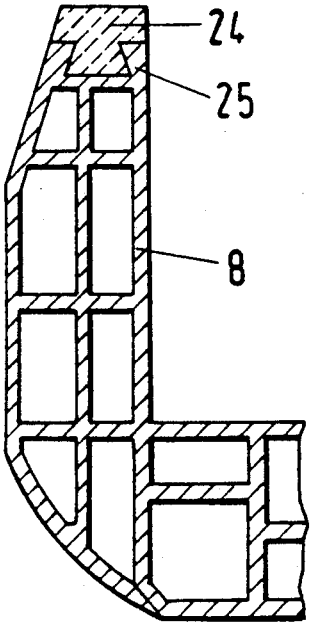
FIG. 8 is a fragmentary, sectional view of a magnetic yoke with a vibration-damping component.

FIG. 5 shows a magnetic yoke with a single-piece extruded profiled part shown in section. In this case, the support body 8 is constructed as an aluminum extruded profiled part having a multiplicity of individual longitudinal channels 13, so that, as seen in cross section, the extruded profiled part is a lattice work having a large number of longitudinal hollow chambers (a similar latticework is shown in FIG. 8). This type of structure (which can also be used for the individual profiled parts of the three-part variant shown in FIG. 4) has a number of advantages. On one hand a high rigidity in relation to bending and torsion is ensured with comparatively low material usage, low material weight and low material cost. On the other hand, a high damping of the radial vibrations transmitted from the cylindrical or furnace coil 3 to the furnace body through the magnetic yokes 4 and the frames or frame rings 6, 7 is produced. The longitudinal channels 13 can at least partly be used as internal cooling channels for circulating a coolant (preferably water), with the result that the large heat transmission area results in a high heat dissipation capability for the heat loss produced during operation. This makes it possible to limit the thermal loading of the magnetic yokes to specified values.

Figure 6:
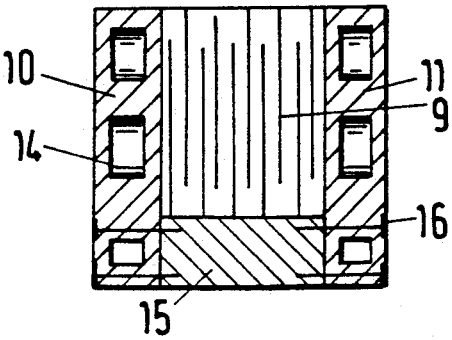
FIG. 6 is a sectional view of a magnetic yoke with three individual profiled parts.

FIG. 6 shows a magnetic yoke with three individual profiled parts in section. It can be seen that the side walls 10, 11, which are preferably formed of aluminum, are provided with internal longitudinal channels 14, whereas the rear wall is constructed as a steel profiled part 15. In this case, the steel profiled part 15 may be of solid construction or it may be constructed as a hollow square profiled part or a hollow rectangular profiled part. The steel profiled part 15 can be fixed to the two side walls 10, 11, for example, by means of fixing screws 16 which fit through bores in the side walls 10, 11 and are anchored in threaded bores in the steel profiled part 15. Alternatively, stay rods can also be welded to the steel profiled part 15, in which case the stay rods are provided with a threaded fit through bores in the side walls 10, 11 and the side walls are clamped against the rear wall by means of nuts that are screwed to the stay rods.

Figure 7:
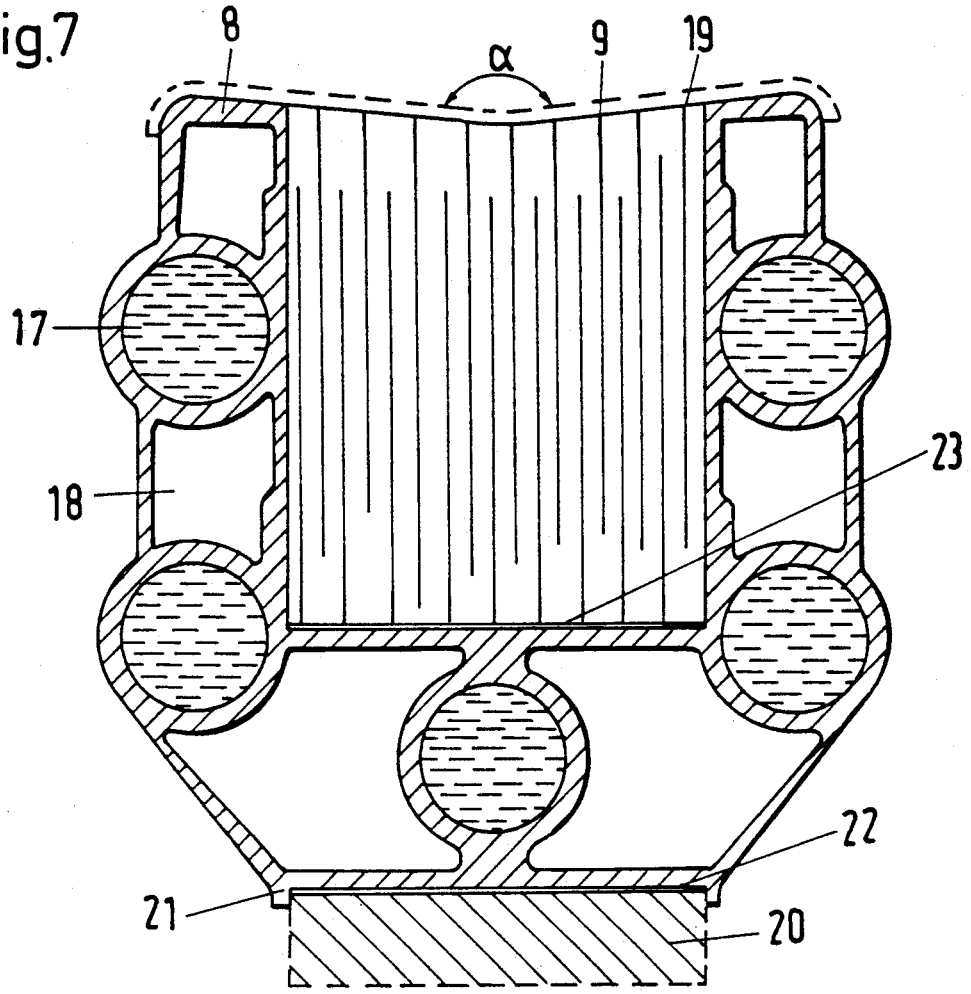
FIG. 7 is a sectional view of a preferred embodiment of the magnetic yoke.

FIG. 7 shows a preferred embodiment of the magnetic yoke in section. The single-piece support body 8 has a plurality of cooling channels 17 (namely five in the exemplary embodiment), each having a circular cross section. In each case, further longitudinal channels 18 having an irregularly shaped cross section are disposed between the cooling channels. The end surface of the active core stack 9 facing the furnace coil 3 and the two end surfaces of the side walls of the support body may be provided with a cover 19 (which is made of mica, for example). An angle alpha having a value of approximately 170° indicates that both the end surface of the support body facing the furnace coil 3 and the matching surface of the core stack are matched to the cylindrical shape of the furnace coil. Two holding lugs 21 for locking a steel profiled part 20 fixed to the rear wall may be formed onto the outer surface of the rear wall of the support body 8. The steel profiled part 20 increases the bending and torsional strength of the support body 8. The steel profiled part is expediently fixed by means of adhesive 22.

The base surface of the active core stack 9 is fixed to the inner surface of the rear wall of the support body 8, such as by an adhesive 23 having high thermal conductivity. As an alternative to this, a thermally conducting paste may be used, in which case the core stack has to be fixed in another way. In this way, a good thermal transmission from the base surface of the core stack 9 to the rear wall of the support body 8 is always ensured. In order to ensure a good heat transmission between the lateral surfaces of the core stack 9 and the side walls of the support body 8 and to suppress troublesome noise generation, the core stack is preferably clamped between the two side walls.

FIG. 8 shows a magnetic yoke having a vibration-damping component in a sectional view. It can be seen that a vibration-damping component 24 (which is made of ceramic or a "TEFLON"-impregnated fibrous ceramic profiled part, for example) is fixed to the end surface of the side wall of the support body 8 facing the furnace coil 3. For this purpose, holding lugs 25 are formed onto the end surfaces of the support body, and a dovetail-type gap is formed between the holding lugs 25 for introducing the matchingly shaped component 24. The vibration-damping component 24 is pressed against the outer casing of the coil 3 and additionally damp the vibration transmission from the furnace coil to the frame rings 6, 7.

Figure 9:
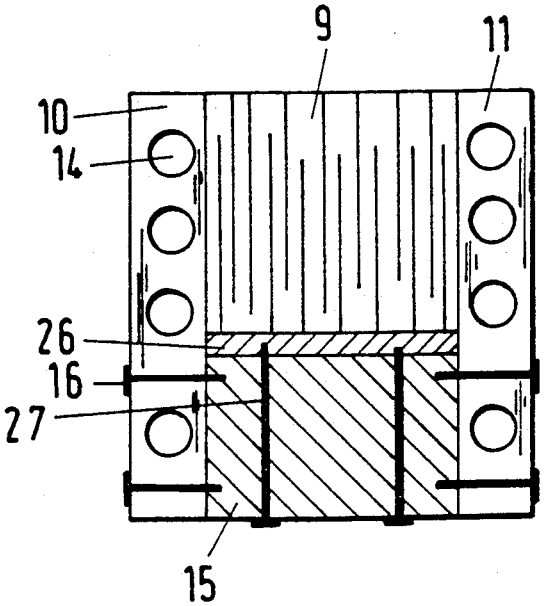
FIG. 9 is a sectional view of a magnetic yoke with a mechanically fixed core stack.

FIG. 9 shows a magnetic yoke with a mechanically fixed core stack in section. In this case, the core stack 9 is provided with one, two or more dovetail-type grooves that are perpendicular to the longitudinal axis (perpendicular or tangential to the diameter of the furnace coil) in its base regio facing the rear wall 12 or the steel profiled part 15 of the support body. Matchingly shaped fixing wedges 26 which press the core stack against the inner surface of the rear wall or of the steel profiled part 15 of the support body through fixing screws 27, fit into the grooves. For this purpose, the fixing screws 27 fit through matching bores in the rear wall or in the steel profiled part 15. The construction of the side walls 10, 11 of the support body with longitudinal channels 14 and the fixing of the side walls to the steel profiled part 15 by means of fixing screws 16 is as explained above in connection with FIG. 6. In FIG. 9, a support body is shown which is made up of three individual profiled parts, but the fixing methods described above for the core stack are also possible in the case of a single-piece support body (see FIG. 3).

Figure 10:
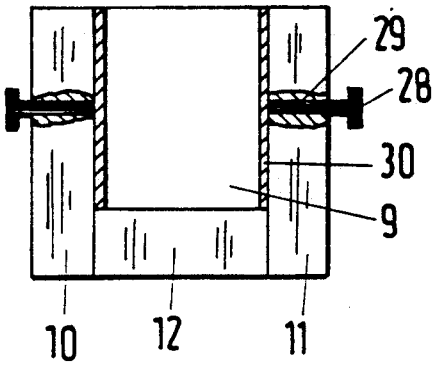
FIG. 10 is a partly broken-away, sectional view of a magnetic yoke with a clamped core stack.

FIG. 10 shows a magnetic yoke with a clamped core stack. In this variant, clamping bolts 28, which have a thrust block 29 thereof in the side walls 10, 11 of the support body, press against the core stack 9. The clamping bolts 28 are tightened with a specified torque in order to achieve an adequate clamping of the core stack 9. In order to uniformly distribute the punctiform compressive forces on the sides of the core stack, rigid cover plates 30 may be respectively provided in each case between a lateral surface of the core stack an and inner surface of the side wall 10 or 11. If necessary, it is possible to adjust the optimum clamping force later by tightening the clamping bolts 28 (for example, in the event of material fatigue or, in principle, after a specified operating time). In particular, a uniform optimum clamping over the entire length of the core stack suppresses any "internal hum" of the core stack.

FIG. 10 shows a support body made up of three individual profiled parts 10 to 12, but the clamping of the core stack explained above can also be employed in the case of a single-piece support body (see FIG. 3).

Figure 11:
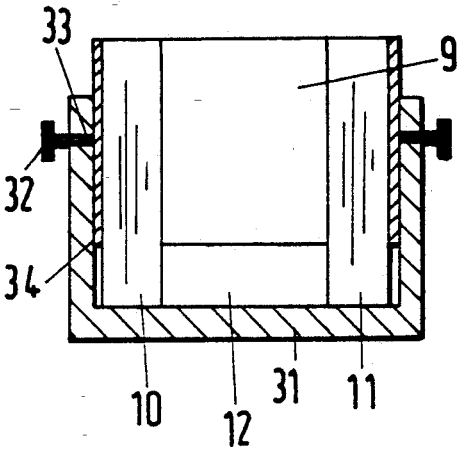
FIG. 11 is a sectional view of a magnetic yoke with clamps for fixing the three individual profiled parts of the support body and the core stack.

FIG. 11 shows a magnetic yoke with clamps for fixing the three individual profiled parts of the support body and the core stack. U or C-shaped clamps 31 can be seen to enclose both the rear wall 12 and the side walls 10, 11. With suitable pretensioning of the clamps 31, it is possible to fix the three individual profiled parts 10 to 12 of the support body without further aids, in which case the core stack 9 is clamped simultaneously by the pressure exerted on the two side walls 10, 11. Alternatively, the use of clamping bolts 32 having a thrust block thereof in the side cheeks or beams of the clamps 31 makes it possible to exert a precisely specified compressive force on the side walls 10, 11 and the core stack 9. In order to additionally distribute the compressive force applied punctiformly through the clamping bolts 32, rigid cover plates 34 may be provided between the side cheeks or beams of the clamps 31 and outer surfaces of the side walls 10, 11.

Figure 12:
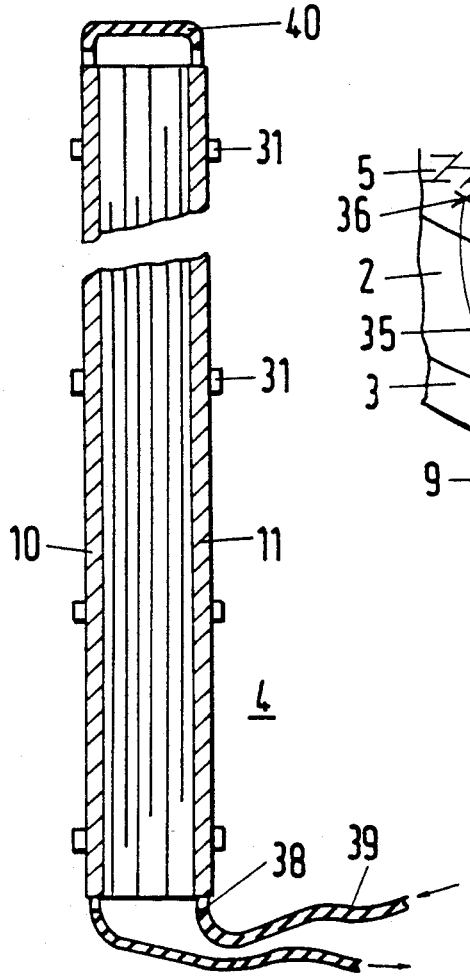
FIG. 12 is a fragmentary, plan view of a magnetic yoke with clamps.

FIG. 12 shows a view of a magnetic yoke with clamps. The rod-shaped magnetic yoke 4 having the side walls 10, 11 of the support body, the clamped core stack 9 and a multiplicity of clamps 31 can be seen. Furthermore, FIG. 12 indicates by way of example how a coolant can be fed in and how it can be returned to an external recooling system. For this purpose, the cooling channels or longitudinal channels can be provided at one end thereof with connecting pieces 38 to which coolant hoses 39 can be attached. The other ends of the cooling channels or longitudinal channels can be joined together by means of U-bends 40. Other generally known coolant connections may also be used. The structure indicated above is, of course, not limited to the variant of the magnetic yoke with clamps, but rather it can be used generally in all of the types of construction.

Figure 13:
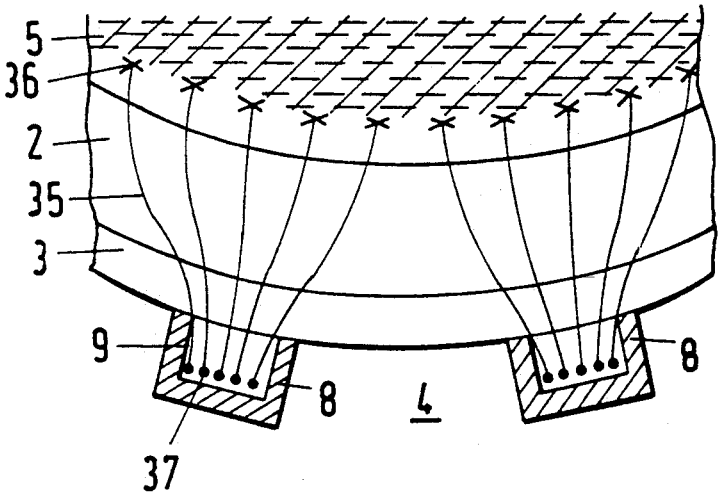
FIG. 13 is a sectional view showing a pattern of the magnetic flux on passing from the magnetic yoke to the melt in the crucible.

FIG. 13 shows the pattern of the magnetic flux upon passing from the magnetic yoke 4 to the melt in the crucible. The magnetic flux emerges from the ends of the core stacks 9 and extends through the crucible 2 to the melt 5 or to the metallic charge material. The magnetic flux in the core stack is denoted by reference numeral 37, the flux in the peripheral region of the furnace coil 3 or of the crucible is denoted by reference numeral 35 and the flux in the metallic charge material or in the melt 5 is denoted by reference numeral 36. The screening action of the support body 8 that is formed of electrically conductive material (preferably an aluminum alloy) prevents the flux in the end region of the magnetic yoke from entering or emerging at right angles to the longitudinal axis of the core stack, with the result that corresponding additional losses are avoided. Reference is made to the above statements in this connection.

I claim:

1. In an induction crucible furnace having a furnace coil generating magnetic flux, a magnetic yoke comprising a rod-shaped core stack for carrying the magnetic flux, said core stack having lateral surfaces, whereby one of said surfaces faces the furnace coil and a support body formed by a flexurally and formically rigid body of U-shaped cross section for enclosing said core stack to allow only said surface facing the furnace coil not to be enclosed, and said lateral surfaces being formed of a material selected from the group consisting of aluminum and an electrically conducting aluminum alloy.

2. The magnetic yoke according to claim 1, wherein said support body has at least one longitudinal channel formed therein.

3. The magnetic yoke according to claim 1, wherein said support body has at least one longitudinal channel formed therein for carrying a coolant.

4. The magnetic yoke according to claim 1, wherein said support body has a one-piece construction.

5. The magnetic yoke according to claim 1, wherein said support body has three parts.

6. The magnetic yoke according to claim 1, wherein said support body includes at least one extruded profiled part.

7. The magnetic yoke according to claim 1, wherein said support body has two side walls, one rear wall and joints between said rear wall and said side walls being formed of fixing screws.

8. The magnetic yoke according to claim 1, wherein said support body has two side walls, one rear wall and joints between said rear wall and said side walls being formed of clamps.

9. The magnetic yoke according to claim 1, wherein said core stack is glued in said support body.

10. The magnetic yoke according to claim 1, wherein said core stack is clamped in said support body.

11. The magnetic yoke according to claim 10, wherein said support body has two side walls and one rear wall, and including clamping bolts having a thrust block in said side walls for clamping said core stack in said support body.

12. The magnetic yoke according to claim 11, including a rigid cover plate disposed between said core stack and said side walls.

13. The magnetic yoke according to claim 8, wherein said clamps clamp said core stack in said support body.

14. The magnetic yoke according to claim 8, wherein said clamps have side cheeks, and including clamping bolts having a thrust block in said side cheeks for clamping said core stack in said support body.

15. The magnetic yoke according to claim 14, including a rigid cover plate disposed between a side cheek of one of said clamps and one of said side walls of said support body.

16. The magnetic yoke according to claim 1, including fixing wedges in said support body for fixing said core stack.

17. The magnetic yoke according to claim 1, including thermally conducting paste between said core stack and said support body.

18. The magnetic yoke according to claim 1, wherein said support body has end surfaces facing said furnace coil, and , including vibration-damping components disposed at said end surfaces.

19. The magnetic yoke according to claim 18, including holding lugs formed onto said support body for fixing said vibration-damping components.

20. The magnetic yoke according to claim 1, wherein said support body has two side walls and one rear wall constructed as a steel profiled part.

21. The magnetic yoke according to claim 1, wherein said support body has at least one principal surface, and including a steel profiled part being fixed on said at least one principal surface.

22. The magnetic yoke according to claim 21, wherein said steel profiled part is glued on said support body.

23. The magnetic yoke according to claim 21, wherein said support body has holding lugs for locking said steel profiled part.

* * * * *